US007327220B2

(12) United States Patent
Hess

(10) Patent No.: US 7,327,220 B2
(45) Date of Patent: Feb. 5, 2008

(54) PORTABLE ALARM AND METHODS OF TRANSMITTING ALARM DATA

(75) Inventor: Brian K. Hess, Westerville, OH (US)

(73) Assignee: TattleTale Portable Alarm Systems, Inc., Westerville, OH (US)

( * ) Notice: Subject to any disclaimer, the term of this patent is extended or adjusted under 35 U.S.C. 154(b) by 143 days.

(21) Appl. No.: 10/867,124

(22) Filed: Jun. 14, 2004

(65) Prior Publication Data

US 2005/0030174 A1 Feb. 10, 2005

Related U.S. Application Data

(60) Provisional application No. 60/477,998, filed on Jun. 11, 2003.

(51) Int. Cl.
*G08B 5/00* (2006.01)

(52) U.S. Cl. ..... 340/286.11; 340/531; 340/539.1; 340/540; 340/541; 340/436

(58) Field of Classification Search ..... 340/286.11, 340/531, 539.1, 540, 541, 426, 436
See application file for complete search history.

(56) References Cited

U.S. PATENT DOCUMENTS

| | | | |
|---|---|---|---|
| 3,925,763 | A | 12/1975 | Wadhwani et al. |
| 4,091,371 | A | 5/1978 | Mason, Jr. et al. |
| 4,157,540 | A | 6/1979 | Oros |
| 4,194,193 | A | 3/1980 | McDonough |
| 4,222,119 | A | 9/1980 | Brunner-Schwer |
| 4,264,899 | A | 4/1981 | Menzies et al. |
| 4,337,462 | A | 6/1982 | Lemelson |
| 4,435,701 | A | 3/1984 | Baon |
| 4,446,454 | A | 5/1984 | Pyle |
| D275,375 | S | 9/1984 | Schwartz |
| 4,520,351 | A | 5/1985 | Altman et al. |
| 4,540,977 | A | 9/1985 | Taillens et al. |
| 4,663,611 | A | 5/1987 | Humphrey |
| 4,667,188 | A | 5/1987 | Schwartz |
| D291,975 | S | 9/1987 | Ching-Hua |
| 4,719,454 | A | 1/1988 | Hopkins et al. |
| 4,742,336 | A | 5/1988 | Hall et al. |
| 4,777,474 | A | 10/1988 | Clayton |

(Continued)

FOREIGN PATENT DOCUMENTS

| | | |
|---|---|---|
| AU | 692 305 | 4/1998 |

(Continued)

OTHER PUBLICATIONS

"Cellemetry Modem Module (CMM) Data Sheet", Standard Communications Corp., Feb. 12, 1996.

(Continued)

*Primary Examiner*—Tai Nguyen
(74) *Attorney, Agent, or Firm*—Rader, Fishman & Grauer PLLC

(57) ABSTRACT

A portable alarm having an intelligent communications interface is provided. The portable alarm may transmit digital wireless data wirelessly to a location external to the portable alarm. Methods of transmitting alarm data from a portable alarm are provided. The alarm data may be converted to wireless digital data and transmitted wirelessly.

24 Claims, 4 Drawing Sheets

U.S. PATENT DOCUMENTS

| | | | | |
|---|---|---|---|---|
| 4,797,657 | A | | 1/1989 | Vorzimmer et al. |
| 4,866,422 | A | | 9/1989 | Dunnett et al. |
| 4,904,983 | A | | 2/1990 | Mitchell |
| 4,908,604 | A | | 3/1990 | Jacob |
| 4,910,493 | A | | 3/1990 | Chambers et al. |
| 4,943,799 | A | | 7/1990 | Papineau |
| 4,951,029 | A | | 8/1990 | Severson |
| D311,349 | S | | 10/1990 | Walsh |
| 4,964,156 | A | | 10/1990 | Blair |
| 5,019,803 | A | | 5/1991 | Maram |
| 5,055,851 | A | * | 10/1991 | Sheffer ..... 342/457 |
| 5,081,667 | A | | 1/1992 | Drori et al. |
| 5,099,228 | A | | 3/1992 | Israel et al. |
| 5,115,224 | A | * | 5/1992 | Kostusiak et al. ..... 340/574 |
| 5,117,223 | A | | 5/1992 | Tanner |
| 5,144,661 | A | | 9/1992 | Shamosh et al. |
| 5,164,705 | A | | 11/1992 | Dunagan et al. |
| 5,200,735 | A | | 4/1993 | Hines |
| 5,202,673 | A | | 4/1993 | Conrad |
| 5,223,816 | A | * | 6/1993 | Levinson et al. ..... 340/539.13 |
| 5,225,713 | A | | 7/1993 | Henneberry et al. |
| 5,255,306 | A | | 10/1993 | Melton et al. |
| 5,255,307 | A | | 10/1993 | Mizikovsky |
| 5,257,007 | A | | 10/1993 | Steil et al. |
| 5,283,549 | A | | 2/1994 | MeHaffey et al. |
| 5,289,534 | A | | 2/1994 | Lester et al. |
| 5,311,570 | A | | 5/1994 | Grimes et al. |
| 5,319,698 | A | | 6/1994 | Glidewell et al. |
| 5,406,261 | A | | 4/1995 | Glenn |
| 5,408,212 | A | | 4/1995 | Meyers et al. |
| 5,463,595 | A | | 10/1995 | Rodhall et al. |
| 5,512,881 | A | | 4/1996 | Majmudar |
| 5,534,847 | A | | 7/1996 | McGregor |
| 5,574,429 | A | | 11/1996 | Streeter |
| 5,587,701 | A | | 12/1996 | Hess |
| D379,157 | S | | 5/1997 | Hess |
| 5,646,592 | A | | 7/1997 | Tuttle |
| 5,680,112 | A | | 10/1997 | Xydis |
| 5,748,084 | A | | 5/1998 | Isikoff |
| 5,764,135 | A | | 6/1998 | Warren |
| 5,777,551 | A | | 7/1998 | Hess |
| 5,815,069 | A | | 9/1998 | Horton |
| 5,836,002 | A | | 11/1998 | Morstein et al. |
| 5,850,180 | A | | 12/1998 | Hess |
| 5,963,131 | A | | 10/1999 | D'Angelo et al. |
| 6,043,733 | A | | 3/2000 | Lind |
| 6,044,257 | A | * | 3/2000 | Boling et al. ..... 455/404.2 |
| 6,049,272 | A | | 4/2000 | Lee et al. |
| 6,049,273 | A | | 4/2000 | Hess |
| 6,078,258 | A | | 6/2000 | Auerbach et al. |
| 6,191,685 | B1 | | 2/2001 | Theofanous et al. |
| 6,384,739 | B1 | * | 5/2002 | Roberts, Jr. ..... 340/905 |
| 6,433,683 | B1 | * | 8/2002 | Robinson ..... 340/540 |
| 6,441,731 | B1 | | 8/2002 | Hess |
| 2002/0113704 | A1 | | 8/2002 | Hess |

FOREIGN PATENT DOCUMENTS

| | | |
|---|---|---|
| CA | 2 036 560 | 8/1992 |
| CA | 2 199 036 | 6/2000 |
| DE | 6 953 3088 | 9/2004 |
| EP | 1 387 332 | 2/2004 |
| EP | 0 780 013 | 5/2004 |
| GB | 2 194 119 | 2/1988 |
| NZ | 293 137 | 7/1998 |
| WO | WO 9607995 | 3/1996 |
| WO | WO 9812068 | 3/1998 |

OTHER PUBLICATIONS

"Cellular Communication Goes Off-Road to Transmit Alarms", *Security*, May 1987, p. 18.

"Make the Switch with TelGuard", Telular Corporation Product Manual, Copyright 1996.

"Motorola S1936/S1936C/S1936D Cellular Connection", Printed Apr. 7, 2003 from www.wirelesspro.com/motrjins1.html.

Crump, "AB1X: Landline Emulator for Cellular", *Personal Communications Technology*, Jun. 1986, pp. 39 and 42.

Evans, "Cellemetry, Network Access Strategy", BellSouth Wireless, Inc., date unknown.

* cited by examiner

PORTABLE ALARM AND METHODS OF TRANSMITTING ALARM DATA

CROSS REFERENCE TO RELATED APPLICATIONS

The present invention claims priority to and incorporates by reference the entirety of U.S. Provisional Patent Application No. 60/477,998 filed Jun. 11, 2003.

BACKGROUND OF THE INVENTION

The present invention relates generally to alarm systems and methods of transmitting alarm data. More particularly, the present invention relates to portable alarm systems having the ability to translate alarm data to wireless digital data and to transmit the wireless digital data wirelessly and methods of such data transmission.

Alarm systems of various types have been in existence for many years. Alarm systems play in integral part in protecting assets within as well as the safety of those within monitored premises. Alarm systems are now available for automobiles as well as for building structures, such as homes, businesses, and the like.

In home alarm systems known today, the alarm systems are usually hard wired throughout a home, with the wiring usually terminating at a control panel located somewhere within the home. One of the chief drawbacks of such a system is the fact that it is permanently installed in the home and offers nothing to the original purchaser of the alarm system when he or she moves from the home. Furthermore, the installation of such an alarm system is labor intensive, and therefore, requires significant expense to pay for the installation. Still further, via their reliance on hard-wired telephone systems, such conventional alarm systems are easy targets for savvy intruders who know how to quickly and easily dismantle the systems by, for example, cutting the telephone lines on which the alarm systems rely.

The conventional security alarm system market does not offer alternatives for the millions of citizens that live, for example, in apartments, a hotel room, a leased office space, short term warehousing, and a multitude of other environments in which a person would not intend to stay for a relatively long period of time and thus would not wish to invest significant expense in a permanent alarm system for that environment and may not even be permitted to do so. It is exactly these types of environments where crime is often the highest.

Home alarm systems are frequently connected to the home's telephone wiring to automatically place a call to a monitor station at some distance away from the home to warn those at the monitor station that a possible illegal entry has occurred at the home. This, in theory, enables those at the monitor station to either send a security officer to the home or to place a call to the police to have a police officer inspect the home where the alarm was activated. A drawback of this type of system is that sophisticated burglars are knowledgeable of such systems and will cut the telephone wires prior to entry into the home, thereby rendering the security monitor station useless because when the illegal entry occurs, the system will not function to place the automatic call to the security monitor station.

Typically, alarm systems that transmit an alarm signal to a location outside of the premises being monitored do so via transmission to a central monitoring station. Often the owner of the premises is not informed of an alarm until further time has elapsed. Once notified, the premise's owner or their agent is only then able to intervene as desired. Further, central monitoring stations and the resources that they dispatch (e.g., police, fire, etc.) charge considerable amounts of money for the services that they provide to the owner of the premises. While the owner may feel that these costs are justified in certain circumstances such as when critical information (e.g., notification of a fire or intruder in the premises being monitored) is transmitted, many owners have experienced frustration with the costs associated with "false alarms" or transmission of non-critical information. Further, there are situations in which the owner may be able to respond more quickly and effectively than the resources that may otherwise be dispatched by the central monitoring station.

Thus, it is desirable for alarm systems to be portable, cost-efficient, and resistant to disarming by savvy intruders. There is also a need for further alarm transmission methods and devices associated with the same. In order to alleviate the frustrations and costs associated with the same, notifying the premise's owner or his or her agent promptly when an alarm signal is generated would be highly desirable in many situations.

SUMMARY OF THE INVENTION

In accordance with an embodiment of the present invention, an alarm is provided. The alarm comprises a portable alarm having an alarm enclosure. The alarm also comprises a processor for receiving alarm data, wherein the processor is in the alarm enclosure, and an intelligent communications interface in the alarm enclosure. The intelligent communications interface is connected to the processor for receiving alarm data. The intelligent communications interface is capable of receiving alarm data from the processor for receiving alarm data. The intelligent communications interface converts at least a portion of the alarm data to wireless digital data, and the intelligent communications interface may cause the wireless digital data to be wirelessly transmitted to a location external to the portable alarm.

In accordance with another embodiment of the present invention, a method for transmitting alarm data from a portable alarm having a processor for receiving alarm data and an intelligent communications interface connected to said processor for receiving alarm data is provided. The method comprises transmitting alarm data from the processor for receiving alarm data to the intelligent communications interface, converting the alarm data to wireless digital data using the intelligent communications interface, and causing the wireless digital data to be wirelessly transmitted from the portable alarm to a service center external from the portable alarm.

BRIEF DESCRIPTION OF THE SEVERAL VIEWS OF THE DRAWINGS

The following detailed description of the preferred embodiments of the present invention can be best understood when read in conjunction with the following drawings, where like structure is indicated with like reference numerals and in which.

DETAILED DESCRIPTION OF PREFERRED EMBODIMENTS

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise. All publications, patent applications, patents, and other references mentioned herein are incorporated by reference in their entirety.

Figure 1:
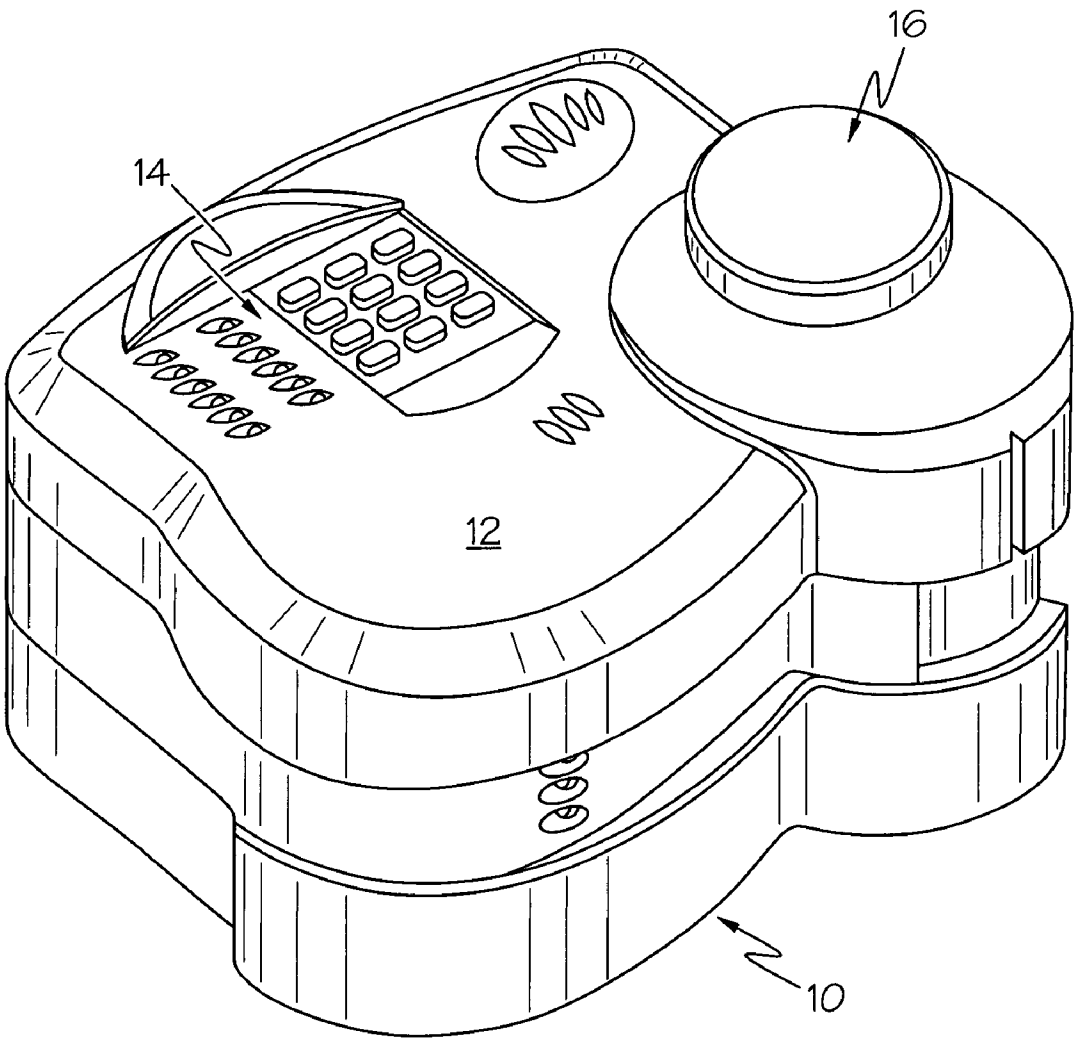
FIG. 1 is a perspective view of an alarm system in accordance with embodiments of the present invention.

FIG. 1 is a perspective view of one embodiment of the present invention. The portable alarm system 10 is contained in a portable enclosure 12. A keypad 14 may be used to input information to the alarm system 10. The portable alarm system may have a strobe light 16 mounted on the outside of the portable enclosure 12.

Figure 2:
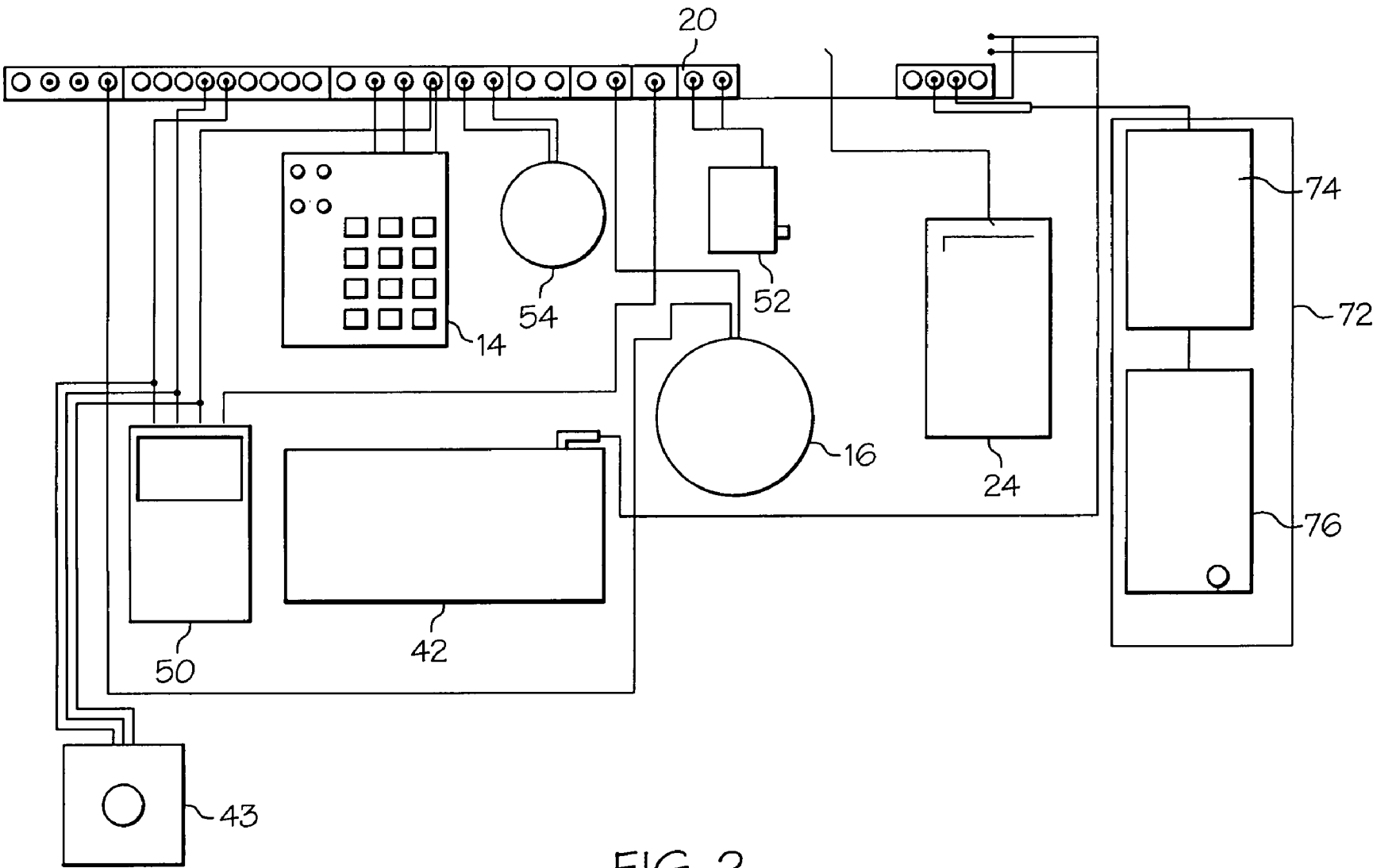
FIG. 2 is a schematic illustration of an alarm system in accordance with embodiments of the present invention.

Referring now to FIG. 2, a schematic view of a portable alarm system 10 and sensors 25 separate from the portable alarm enclosure 12 are illustrated. It will be understood that any suitable portable alarm system may be used in conjunction with the present invention, such as the alarm systems illustrated in U.S. Pat. Nos. 6,441,731; 6,049,273; 5,8850,180; 5,777,551; and 5,587,701 which are incorporated by reference herein. The alarm system 10 has a processor 20 such as a microprocessor that controls the alarm system 10. The microprocessor 20 receives alarm data. The microprocessor 20 may be a microcomputer based control panel. For example, the microprocessor 20 may be a commercially available alarm board or any other suitable type of microprocessor board. The microprocessor 20 processes data received from various inputs and sends appropriate signals to other components of the alarm system 10 according to the received inputs as discussed below.

The keypad 14 is electrically connected to the microprocessor 20. For example, the keypad 14 may be wired to clock, data, and communications inputs of the microprocessor 14. The keypad 14 may be used to program the alarm system 10 according to specific user needs. For example, the keypad 14 may be capable of multiple user codes which may be inputted to arm or disarm the alarm system 10. Additionally, the keypad 14 may be used to activate a panic feature that allows the user to activate an alarm sequence by the push of one, two, or more buttons. Additionally, the panic feature may be provided remotely from the keypad 14. For example, the a remote panic button may be worn on a necklace of the user.

The keypad 14 may also be used to send a silent distress signal by actuating predetermined code numbers on the keypad 14. The keypad 14 also allows the user to program and configure the alarm system 10 in any suitable manner. For example, the user may program the alarm system 10 to monitor or bypass all or specific intruder zones or program specific alarm parameters.

A wireless receiver 24 may be contained within the enclosure 12 and electrically connected to the microprocessor 24. The wireless receiver 24 may receive alarm signals from remote wireless devices (not shown) that may be used to monitor windows, doors, or may be motion sensors, wireless smoke detectors, and the like. If a signal is received by the wireless receiver 24 that indicates an alarm, the microprocessor 20 will cause an alarm.

The microprocessor 20 may be connected to a power transformer 52 to provide current to the microprocessor from a source such as a conventional wall outlet. The AC inputs of the microprocessor 20 may be wired to the transformer 52. A battery 42 may act as a back-up power supply to the transformer 52, and the battery 42 may be recharged by receiving a trickle charge from the transformer 52.

The portable alarm enclosure 12 may have a motion sensor or sensors 50. The motion sensor 50 may be any suitable motion sensor. The motion sensor 50 may be wired to any appropriate input location, such as a communications terminal, of the microprocessor 20.

The motion sensor 50 will send an activation signal to the microprocessor 20 when the sensor 50 is activated. The microprocessor 20 is programmed to recognize input signals from the motion sensor 50 and to cause an alarm when such signals are received.

The portable alarm enclosure 12 may also include a miniature surveillance camera 43. Any suitable camera 43 may be used. For example, a model TVX-01 camera available from TVX, Inc. in Broomfield, Colo. may be used. The camera 43 is electrically connected to the microprocessor. The alarm system 10 may have a siren 54 that is electrically connected to the microprocessor 20 and that may be activated by a signal from the microprocessor 20. It will be understood that the portable alarm system 10 may have more components or fewer components than illustrated as desired, and it will be understood that the present invention is not limited to the illustrated components.

The alarm system 10 has an intelligent communications interface 72 that comprises an intelligent communications board 74 and a radio component 76. The intelligent communications interface is connected to the microprocessor 20. The intelligent communications interface 72 may be any suitable interface that may receive alarm data from the microprocessor 20 and translate the alarm data to wireless digital data. For example, the intelligent communications interface 72 may have a microprocessor board 74 that is programmed to receive alarm data and translate any desired portion of the alarm data to wireless digital data.

The intelligent communications interface 72 may be programmed to translate any desired alarm data to any suitable type of wireless digital data for further transmission as discussed further herein. For example, the wireless digital data may comprise textual digital data such as short message service (SMS) type data. SMS was created when it was incorporated into the Global System for Mobiles (GSM) digital mobile phone standard. That technology, which is now widely available and used, provides the ability to send and receive text messages to and from, for example, mobile telephones. The text can comprise words or numbers or an alphanumeric combination. When the wireless digital data comprises SMS type data, the intelligent communications interface 72 may convert the alarm data to a text based command set, such as an AT command set, for SMS type transmission. In another example, the alarm data may be converted to multimedia messaging service (MMS) type data or general packet radio services (GPRS) type data.

The intelligent communications interface 72 radio 76 may be any suitable type of radio. The radio 74 is selected to be capable of transmitting and receiving the desired type of wireless digital data. For example, the radio 74 may be a cell phone that may transmit and receive SMS type data. The radio 74 may transmit the wireless digital data to any suitable type of service station as discussed further herein.

The alarm system 10 of the present invention may additionally have a call feature that is activated by the microprocessor 20 that places a call to a central monitoring center in addition to the transmission of the wireless digital data by the intelligent communications interface 72. Suitable systems for placing such a call by landline, cell phone, and Cellemetry are disclosed in U.S. Pat. Nos. 6,441,731; 6,049,273; 5,8850,180; 5,777,551; and 5,587,701 which are incorporated by reference herein.

Figure 3:
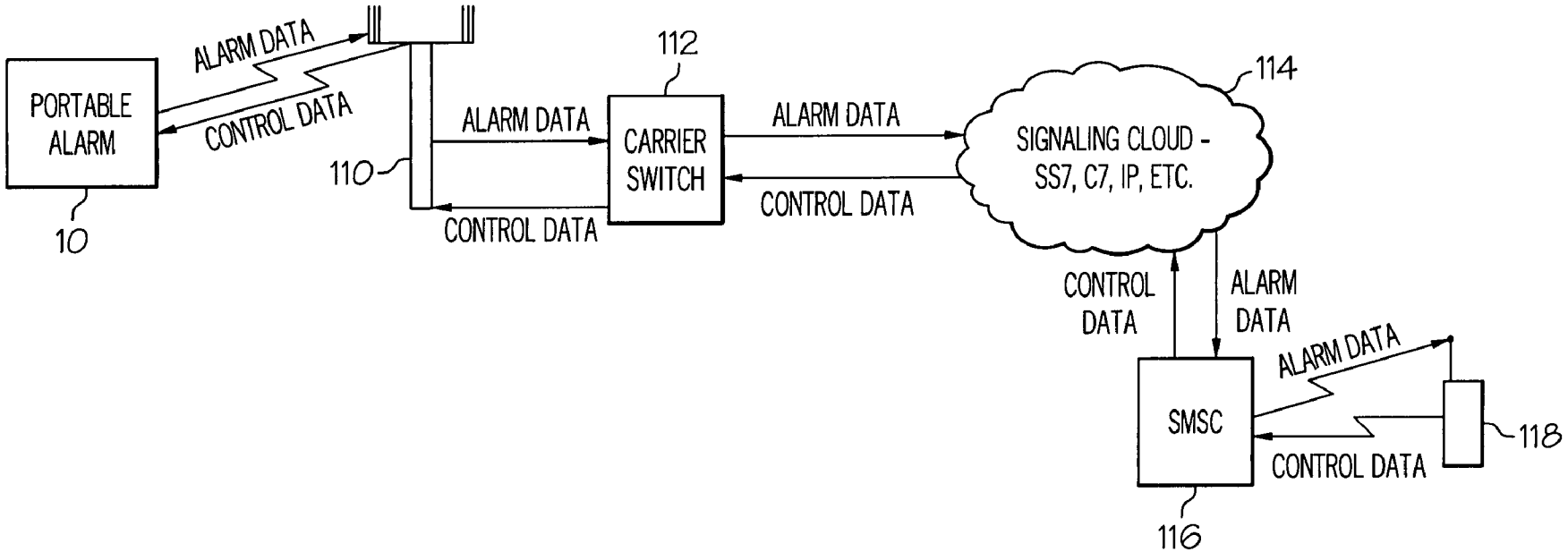
FIG. 3 is a flow diagram illustrating the flow of alarm information to and from a digital device.

Referring now to FIGS. 2 and 3, the transmission of the wireless digital data in accordance with one embodiment of the invention will be discussed. It will be understood that although the wireless digital data is illustrated as being of SMS type data, the wireless digital data may be of any type. Upon receipt of alarm data from the microprocessor 20, the intelligent communications interface 72 determines what alarm data should be converted to wireless digital alarm data, and converts the data to SMS type data. Additionally, the intelligent communications interface 72 determines where the data should be sent based on the programming of the intelligent communications interface 72, and the intelligent communications interface 72 transmits the wireless digital alarm data via the radio 76 to a radio tower 110. It will be understood that the intelligent communications interface may transmit the data to as many locations as desired.

The wireless digital alarm data is received by the tower 110 and transmitted to a carrier switch 112. The wireless digital alarm data is then transmitted via a signaling cloud 114 to a service center 116 such as a short message service center (SMSC). The wireless digital alarm data may be transmitted via any suitable type of network signal. For example, the data may be transmitted via the SS7 (Signal System 7) generic data transmission network conventionally used in the United States and available through companies such as VeriSign Inc. (Mountain View, Calif.) and TSI Telecommunications Services Inc. (Tampa, Fla.)), the C7 network that is the data transmission network comparable to SS7 that is conventionally used in European countries, and/or the IP (internet protocol) transmission network, or any other similar data transmission networks.

The service center 116 then transmits the wireless digital alarm data in the form of a text message to the appropriated digital device 118, and an acknowledgement of receipt of the data may be sent back to the alarm 10 either from the service center 116 or from the tower 110. The digital device 118 may be any suitable device capable of receiving SMS type data. For example, the digital device 118 may be a cell phone, personal digital assistant, internet enabled computer, or the like. In this manner, the alarm user may receive a notification of the alarm on the digital device 118. Although the digital device 118 is illustrated as being in direct communication with the service center 116, communications between digital device 118 and the service center 116 may effected in a variety of ways, such as via a signaling cloud 114 and transmission tower, such as tower 110.

Additionally, control data may be sent by the digital device 118 to the intelligent communications interface 72. The control data may be in the form of an SMS text message that is received by the service center 116 and transmitted to the portable alarm system 10 via any desired network. Once the control data is received by the intelligent communications interface 72, the intelligent communications interface 72 may translate the control data into the appropriate data format and transmit the data to the microprocessor 20 so that the alarm 10 may be controlled remotely. The interactive alarm processor 72 may be programmed to allow any suitable type of alarm control such as arming or disarming via a remote device.

Figure 4:
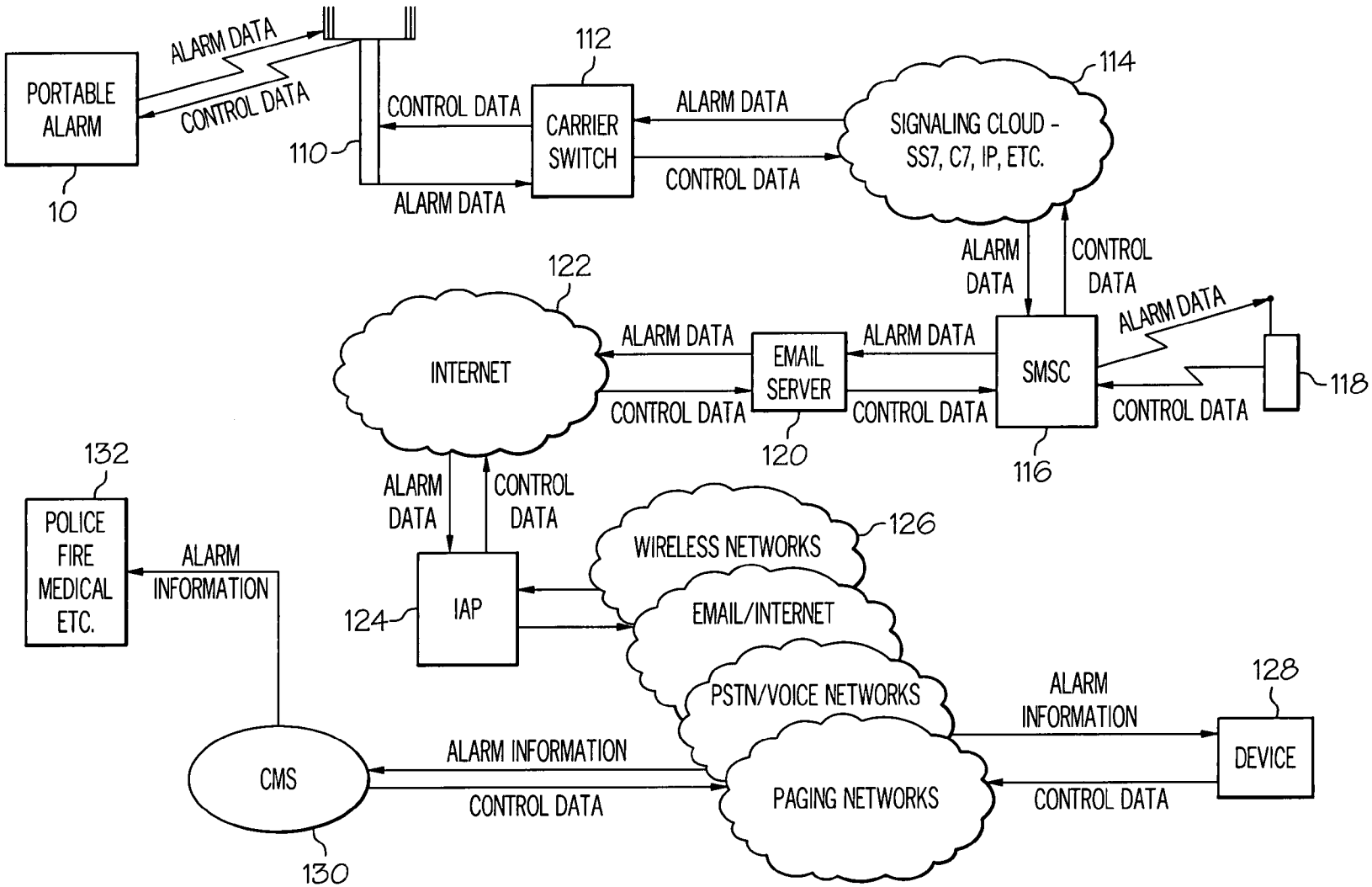
FIG. 4 is a flow diagram illustrating the flow of alarm information with an interactive alarm processor.

Referring now to FIGS. 2 and 4, an alternative embodiment of the present invention is illustrated. The intelligent communications interface 72 may transmit data directly to a digital device 118 as discussed above in accordance with the embodiment illustrated in FIG. 3. In addition to or instead of the transmission of the wireless digital alarm data being transmitted to a digital device 118 via the service station 116, the intelligent communications interface 72 may be programmed to transmit the wireless digital alarm data to an interactive alarm processor 124 for processing and further transmittal as discussed herein. The service station 116 may transmit the wireless digital alarm data to the interactive alarm processor 124 in any suitable manner. For example, the wireless digital alarm data may be transmitted to an e-mail server 120 and then transmitted via the internet 122 to the interactive alarm processor 124.

The interactive alarm processor 124 is any suitable device that is capable of receiving the information transmitted from intelligent communications interface 72 and rerouting that information as desired to one or more of the locations as discussed herein. For example, as schematically illustrated in FIG. 4, the interactive alarm processor 124 may be a remotely hosted, internet accessible, user-configurable routing device. In one embodiment, a wide variety of commercially available computer servers can be used in conjunction with appropriate software to function as the interactive alarm processor 124. Those of ordinary skill in the art of computer programming can readily design such software if a suitable alternative is not found to be commercially available. LINUX and C++, for example, are able to be so adapted to effect desired receipt and rerouting of information received from the alarm system 10.

The interactive alarm processor 124 may be programmed to confirm successful receipt of data transmitted from the intelligent communications interface 72, and a confirmation or acknowledgement of the successful receipt of the wireless digital alarm data may be provided by the interactive alarm processor 124 to the intelligent communications interface 72. Based on the receipt, or lack thereof, of such a confirmation, the intelligent communications interface 72 can resend the information or send the information to one or more alternative destinations, based on its programming.

Once the interactive alarm processor 124 has received the wireless digital alarm data, the interactive alarm processor 124 may process and transmit the data in accordance with its programming. In one example, the wireless digital alarm data may be processed into alarm information for dispersal to further locations as discussed herein. For example, the interactive alarm processor 124 may be initially programmed with an identification of the portable alarm 10 and with information about what alarm information to send and where to send alarm information in the event of the receipt of wireless digital alarm data from a particular portable alarm 10.

In one embodiment, the interactive alarm processor 124 may be programmed to transmit the alarm information derived from the alarm data to at least one device 128. The interactive alarm processor 124 formats the alarm data. For example, the interactive alarm processor 124 may translate the alarm data into alarm information having the necessary format for further transmission to the at least one device 128 via any suitable network 126. Examples of suitable networks 126 include, but are not limited to, wireless networks, email/internet networks, PSTN/voice networks, and/or paging networks. The interactive alarm processor 124 then transmits the alarm information to at least one device 128 via the appropriate network 126. The device 128 may be any suitable device such as wired, wireless, portable, or static device. For example, the device 128 may be a cellular telephone, pager, personal digital assistant, an internet server, public switched telephone network (PSTN), or e-mail account of the premise's owner or agent. The alarm information may be formatted and sent to a plurality of devices 128.

The device 128 may receive any suitable notification from the interactive alarm processor 124 such as alarm information indicating that an alarm has occurred. The device 128 may send control data to the alarm system 10 via the interactive alarm processor 124 and the service center 116 as illustrated. Thus, the portable alarm 10 may be remotely controlled via the interactive alarm processor 124. For example, the alarm 10 may be disarmed remotely. Additionally, the status of the alarm 10 may be checked remotely from the device 128.

The interactive alarm processor 124 may additionally format and send alarm information to a conventional central monitoring station 130. The central monitoring station 130 may further send out alarm information to emergency personnel 132, such as the police, fire department, or emergency medical services. The central monitoring station 130 may also send control data or any other type of information to the interactive alarm processor 124, and the central monitoring station may remotely control the alarm 10 in the same manner as the device 128.

The interactive alarm processor 124 may be configured by a user to provide alarm information in any desired manner. For example, the interactive alarm processor 124 could be accessed via the internet by a user, and the interactive alarm processor 124 could be programmed to send a notification in the event of an alarm to any number or user supplied devices 128. Additionally, the interactive alarm processor 124 may be accessed or programmed to assist in alarm troubleshooting.

It will be obvious to those skilled in the art that various changes may be made without departing from the scope of the invention, which is not to be considered limited to what is described in the specification.

What is claimed is:

1. An alarm, comprising:

a portable alarm having an alarm enclosure;

a processor for receiving alarm data, wherein said processor is in said alarm enclosure; and an intelligent communications interface in said alarm enclosure wherein:

said intelligent communications interface is connected to said processor;

said intelligent communications interface is configured to receive alarm data from said processor;

said intelligent communications interface converts at least a portion of said alarm data to wireless digital data; and said intelligent communications interface is configured to wirelessly transmit said wireless digital data to a location external to said portable alarm, wherein said location comprises an interactive alarm processor that processes said wireless digital data and transmits said processed wireless digital data to any fixed or portable device;

wherein said fixed or portable device sends control data to said interactive alarm processor, and wherein said interactive alarm processor processes said control data and sends said control data to said intelligent communications interface.

2. The alarm as claimed in claim 1 wherein said location comprises a device.

3. The alarm as claimed in claim 2 wherein said wireless digital data is transmitted to said device via a service center.

4. The alarm as claimed in claim 1 wherein said location comprises a plurality of locations.

5. The alarm as claimed in claim 1 wherein said location comprises a service center.

6. The alarm as claimed in claim 1 wherein said wireless digital data comprises digital textual data.

7. The alarm as claimed in claim 6 wherein said digital textual data comprises a short message service type data.

8. The alarm as claimed in claim 1 wherein said wireless digital data comprises a multimedia messaging service type data.

9. The alarm as claimed in claim 1 wherein said wireless digital data comprises a general packet radio service type data.

10. The alarm as claimed in claim 1 wherein said intelligent communications interface further comprises a radio that transmits said digital wireless data to said location.

11. The alarm as claimed in claim 1 wherein said control data controls said portable alarm.

12. The alarm as claimed in claim 1 wherein said central monitoring station sends control data to said interactive alarm processor, and wherein said interactive alarm processor processes said control data and sends said control data to said intelligent communications interface.

13. The alarm as claimed in claim 12 wherein said control data from said central monitoring station controls said portable alarm.

14. A method for transmitting alarm data from a portable alarm having a processor for receiving alarm data and an intelligent communications interface connected to said processor for receiving alarm data, comprising:

transmitting alarm data from said processor for receiving alarm data to said intelligent communications interface;

converting said alarm data to wireless digital data using said intelligent communications interface;

causing said wireless digital data to be wirelessly transmitted from said portable alarm to a service center external from said portable alarm;

transmitting said wireless digital data from said service center to an interactive alarm processor;

processing said wireless digital data in said interactive alarm processor and further transmitting said processed wireless digital data to another device; and sending control data from said device to said interactive alarms processor, processing the control data to a wireless digital data format in said interactive alarm processor, and transmitting said control data to said intelligent communications interface.

15. The method as claimed in claim 14 wherein said step of converting said alarm data to wireless digital data comprises converting said alarm data to textual digital data.

16. The method as claimed in claim 14 wherein said step of converting said alarm data to wireless digital data comprises converting said alarm data to a data type selected from a short message service type, a multimedia messaging service type, and a general packet radio service type.

17. The method as claimed in claim 14 further comprising the step of transmitting said wireless digital data from said wireless service center to a digital device.

18. The method as claimed in claim 17 wherein said digital device is portable.

19. The method as claimed in claim 17 further comprising the steps of transmitting control data from said portable digital device to said service center and transmitting said control data from said service center to said intelligent communications interface.

20. The method as claimed in claim 14 further comprising the step of processing said wireless digital data in said interactive alarm processor and further transmitting said processed wireless digital data to a central monitoring station.

21. The method as claimed in claim 20 wherein said device is selected from a portable device and a static device.

22. The method as claimed in claim 20 wherein said processed digital data is transmitted to said device via a network selected from a wireless network, an internet network, a voice network, and a paging network.

23. The method as claimed in claim 20 further comprising the steps of sending control data from said central mentoring station to said interactive alarms processor, processing the control data to a wireless digital data format in said interactive alarm processor, and transmitting said control data to said intelligent communications interface.

24. The method as claimed in claim 14 further comprising configuring said interactive alarm processor such that a user may access and configure said interactive alarm processor.

* * * * *